US005922642A

United States Patent [19]

Tamura et al.

[11] Patent Number: 5,922,642

[45] Date of Patent: Jul. 13, 1999

[54] IMAGE-RECEIVING SHEET FOR THERMAL TRANSFER PRINTING AND PRINTED MATERIAL

[75] Inventors: Yoshihiko Tamura; Shino Takao, both of Shinjuku-ku, Japan

[73] Assignee: Dai Nippon Printing Co., Ltd., Tokyo-to, Japan

[21] Appl. No.: 08/780,058

[22] Filed: Dec. 23, 1996

[30] Foreign Application Priority Data

| | | | |
|---|---|---|---|
| Dec. 26, 1995 | [JP] | Japan | 7-350791 |
| Dec. 27, 1995 | [JP] | Japan | 7-351272 |
| Jan. 17, 1996 | [JP] | Japan | 8-022961 |

[51] Int. Cl.[6] ..... B41M 5/035; B41M 5/38

[52] U.S. Cl. ..... 503/227; 428/195; 428/206; 428/327; 428/331; 428/423.1; 428/488.4; 428/500; 428/520; 428/913; 428/914

[58] Field of Search ..... 8/471; 428/195, 428/206, 323, 337, 484, 488.1, 488.4, 913, 914, 327, 423.1, 500, 520; 503/227

[56] References Cited

FOREIGN PATENT DOCUMENTS

| | | | |
|---|---|---|---|
| 8-230337 | 9/1996 | Japan | 503/227 |
| 8-244362 | 9/1996 | Japan | 503/227 |

*Primary Examiner*—Bruce H. Hess
*Attorney, Agent, or Firm*—Ladas & Parry

[57] ABSTRACT

An image-receiving sheet for thermal transfer printing comprises a substrate, a color receptor layer formed on one surface of the substrate, and a back surface layer formed on an other surface of the substrate. The back surface layer comprises thermoplastic resin and hydrophilic porous microsilica which is obtained by a wet process and has a pore volume of from 0.2 to 3.0 ml/g. It is possible to write with any kind of writing means on the back surface layer, and a stamp can be stuck thereon. When printing information is recorded on the color receptor layer of the image-receiving sheet for thermal transfer printing, the image-receiving sheet therefor is converted into a printed material which may be used as a picture postcard.

21 Claims, 3 Drawing Sheets

IMAGE-RECEIVING SHEET FOR THERMAL TRANSFER PRINTING AND PRINTED MATERIAL

BACKGROUND OF THE INVENTION

The present invention relates to an image-receiving sheet for thermal transfer printing and a printed material, and more specifically to an image-receiving sheet for thermal transfer printing, which is used for forming an image by thermally transferring coloring agents such as dye, etc. by means of a thermal head or the like, and is provided on the back thereof with a back surface layer having functions such as a writing property with the use of any kind of writing means and a property causing a stamp to be stuck thereon (hereinafter referred to as the "stamp adhesion property"), in addition to properties (for example, adaptability to a printer) which are inherently required for the image-receiving sheet for thermal transfer printing, as well as a printed material which is converted from such an image-receiving sheet for thermal transfer printing.

The image-receiving sheet for thermal transfer printing and the printed material of the present invention may be used as a picture postcard without causing any problems.

On one surface of an image-receiving sheet for thermal transfer printing, there has conventionally been formed a color receptor layer for the purpose of improving receptivity and retain ability of coloring agents such as dye or the like on the surface thereof. On the other surface of the image-receiving sheet for thermal transfer printing, there has also conventionally been formed a back surface layer for imparting a suitable lubricity, releasability and stain-resistance to the image-receiving sheet for thermal transfer printing so as to improve a feeding property when automatically feeding papers in a printer, prevent the heat-fusing of the thermal transfer sheet and the image-receiving sheet, when the image-receiving sheet has inadvertently been supplied upside down into a printer, and prevent the dye or the like from transferring to the back surface of the image-receiving sheet, the deterioration of the image strength and a stain of the back surface thereof, when the image-receiving sheets after the thermal transfer printing had been stacked and stored.

There has recently been an increased demand on using the image-receiving sheet for thermal transfer printing as a postcard such as a picture postcard. As a result, there has been necessity of thermally transfer-printing a colored image such as a color photo on the surface of the image-receiving sheet, and of writing an address and/or a message on the back surface of the image-receiving sheet, and sticking a stamp thereon, thereby imparting the writing property and the stamp adhesion property, to the image-receiving sheet, in addition to the above-described thermal transfer printing property.

As for means for supplying such a demand, a hydrophilic filler has been added to the back surface layer to form a porous body, thereby imparting a writing property with the use of an aqueous-ink type pen such as a fountain pen to the back surface layer as well as imparting the stamp adhesion property to the back surface layer, or inorganic or organic rigid filler has been added to the back surface layer, thereby imparting a writing property with the use of a graphite-type writing means such as a pencil to the back surface layer.

However, the above-described methods of imparting the writing property with the use of the aqueous-ink type pen to the back surface layer by forming the porous body with the addition of a normal hydrophilic filler to the back surface layer and imparting the property causing the stamp to be stuck thereon to the back surface layer, and imparting the writing property with the use of the graphite-type writing means to the back surface layer by adding the inorganic or organic rigid filler to the back surface layer, have not provided sufficient properties which have been applicable to a postcard on which not only the stamp has been stuck, but also a writing is made by any kind of writing means such the aqueous-ink type pen, the pencil or the like. When the above-mentioned properties have been imparted to the image-receiving sheet in accordance with the above-described methods, there have been caused problems of deteriorating lubricating property and other properties, which have inherently been required for the back surface of the image-receiving sheet for thermal transfer printing.

SUMMARY OF THE INVENTION

An object of the present invention is therefore to solve the above-mentioned problems of the prior art.

More specifically, the first object of the present invention is to provide an image-receiving sheet for thermal transfer printing, in which the back surface layer has a good writing property with the use of any kind of writing means and a good stamp adhesion property.

The second object of the present invention is to provide an image-receiving sheet for thermal transfer printing, in which the back surface layer has a good writing property with the use of any kind of writing means and a good stamp adhesion property, and properties inherently required for the image-receiving sheet for thermal transfer printing are not deteriorated. More specifically, the second object of the present invention is to provide the image-receiving sheet for thermal transfer printing, which has a proper lubricative property to a printer, a proper feeding property even when automatically feeding papers in a printer, has no problem of the transfer of the dye or the like to the back surface of the image-receiving sheet, when the image-receiving sheets after the thermal transfer printing had been stacked and stored, and further is provided with a back surface having a good writing property with the use of any kind of writing means and a good stamp adhesion property.

The third object of the present invention is to provide a printed material obtained by a thermal transfer printing, which is provided with a back surface having a good writing property with the use of any kind of writing means and a good stamp adhesion property.

The fourth object of the present invention is to provide a printed material obtained by a thermal transfer printing, which can be used as a picture postcard without causing any problems.

There were carried out extensive studies of a filler to be contained in a back surface layer of the image-receiving sheet for thermal transfer printing, in order to solve the above-mentioned problems. As a result, there were obtained findings that, since microsilica produced by a wet process was porous and had on the surface thereof the silanol group (—SiOH) as a hydrophilic functional group, such microsilica had a higher water-absorbability than that of a normal hydrophilic filler, permitted to improve a writing property with the use of an aqueous-ink type pen and a stamp adhesion property, and there were also obtained sufficient rigidity to impart a writing property with the use of a graphite-type writing means such as a pencil to the back surface layer by controlling the porosity of the microsilica, i.e., by selecting microsilica having a proper pore volume. The present invention was made by adding such microsilica to the back surface layer together with thermoplastic resin on the basis of the above-described findings.

An image-receiving sheet for thermal transfer printing, provided by the present invention comprises a substrate; a color receptor layer formed on one surface of the substrate; and a back surface layer formed on an other surface of the substrate, the back surface layer comprising thermoplastic resin and hydrophilic porous microsilica which is obtained by a wet process and has a pore volume of from 0.2 to 3.0 ml/g.

A printed material provided by the present invention comprises a substrate; a color receptor layer formed on one surface of the substrate, in which layer there is recorded printing information by means of a thermal transfer printing; and a back surface layer formed on an other surface of the substrate, the back surface layer comprising thermoplastic resin and hydrophilic porous microsilica which is obtained by a wet process and has a pore volume of from 0.2 to 3.0 ml/g.

It is preferable to use, as the hydrophilic porous microsilica having the pore volume of from 0.2 to 3.0 ml/g, at least one of plural kinds of hydrophilic porous microsilica having different pore volume within a range of from 0.2 to 0.9 ml/g, as well as at least one of the other plural kinds of hydrophilic porous microsilica having different pore volume within a range of from 1.2 to 3.0 ml/g, to remarkably improve a writing property with the use of any kind of writing means.

It is also preferable to form the back surface layer and a release layer in this order on the back surface of the substrate, which release layer comprises polyvinyl alcohol having a polymerization degree of from 500 to 3,000 and a saponification degree of from 50 to 95%, to effectively prevent the thermal transfer sheet and the image-receiving sheet from being heat-fused to each other, when the image-receiving sheet is inadvertently supplied upside down into a printer.

DESCRIPTION OF THE PREFERRED EMBODIMENTS

Now, materials for the image-receiving sheet for thermal transfer printing of the present invention, a manufacturing method thereof and the printed material obtained will be described hereinbelow on the basis of the preferred embodiments.

Figure 1:
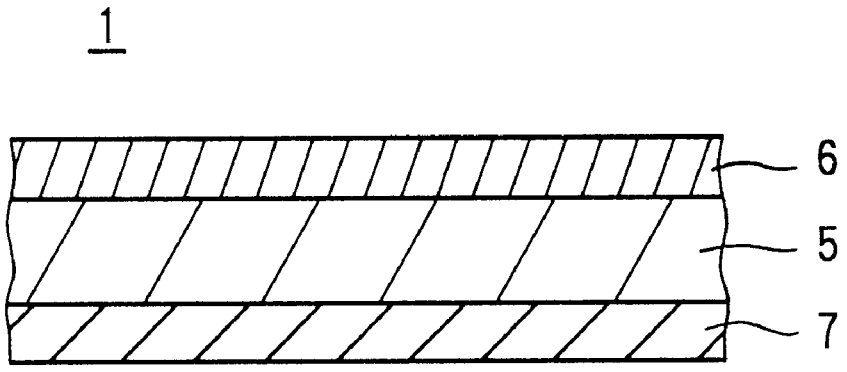
FIG. 1 is a schematic sectional view illustrating an embodiment of the image-receiving sheet for thermal transfer printing of the present invention.
Figure 2:
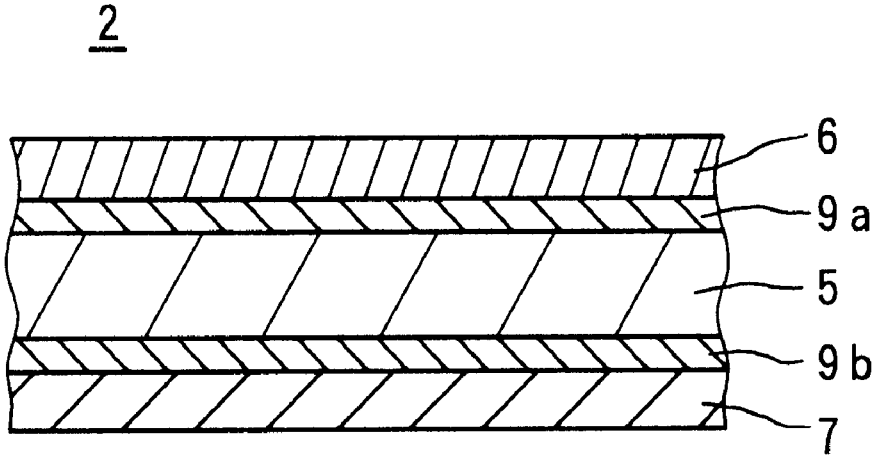
FIG. 2 is a schematic sectional view illustrating another embodiment of the image-receiving sheet for thermal transfer printing of the present invention.

FIGS. 1 and 2 are schematic sectional view illustrating constructions of embodiments of the image-receiving sheet for thermal transfer printing of the present invention, respectively. The constructions of the image-receiving sheet for thermal transfer printing of the present invention are not limited only to those as shown in FIGS. 1 and 2. In the figures, the same reference numerals are added to the same elements in the different embodiments of the present invention.

In FIG. 1, there is shown the image-receiving sheet 1 for thermal transfer printing, which has a construction in which there is formed on one surface of a substrate 5, a color receptor layer 6 which receives coloring agents such as dye or the like for forming images by means of thermal transfer printing, and there is formed on the other surface of the substrate 5 a back surface layer 7 for imparting properties such as a lubricative property to a printer, stain-resistance, a writing property and a stamp adhesion property to the image-receiving sheet.

In FIG. 2, there is shown the image-receiving sheet 2 for thermal transfer printing, which has a construction in which, prior to the formation of the color receptor layer 6 on one surface of the substrate 5 and to the formation of the back surface layer 7 on the other surface of the substrate 5 for imparting properties such as the lubricative property to the printer, the stain-resistance, the writing property and the stamp adhesion property to the image-receiving sheet, an intermediate layer 9*a* is formed, as required, between the substrate 5 and the color receptor layer 6, and another intermediate layer 9*b* is formed, as required, between the substrate 5 and the back surface layer 7, in order to improve adhesiveness to the substrate 5 and whiteness, and other properties.

Figure 3:
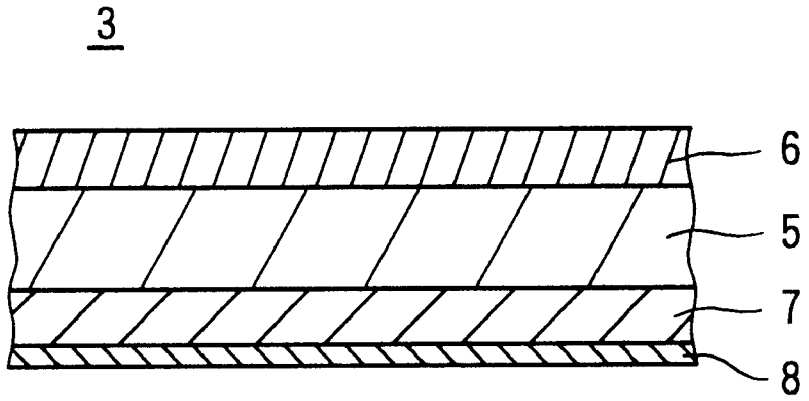
FIG. 3 is a schematic sectional view illustrating further another embodiment of the image-receiving sheet for thermal transfer printing of the present invention.

The image-receiving sheet 3 for thermal transfer printing as shown in FIG. 3 has the same fundamental layer construction as that of the image-receiving sheet 1 for thermal transfer printing as shown in FIG. 1, and in the former, a release layer 8 is formed on the back surface layer 7.

Figure 4:
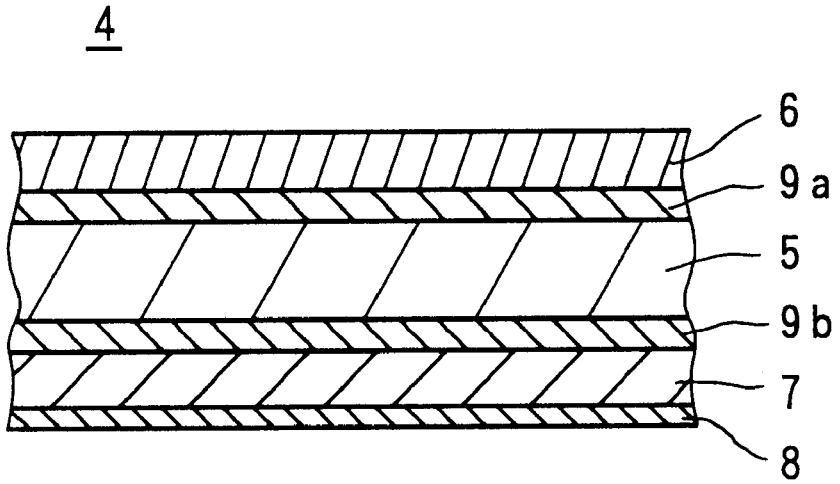
FIG. 4 is a schematic sectional view illustrating still further another embodiment of the image-receiving sheet for thermal transfer printing of the present invention.

The image-receiving sheet 4 for thermal transfer printing as shown in FIG. 4 has the same fundamental layer construction as that of the image-receiving sheet 2 for thermal transfer printing as shown in FIG. 2, and in the former, a release layer 8 is formed on the back surface layer 7.

Substrate sheet

The substrate 5 is required to have a sufficient strength to support the color receptor layer 6 and the back surface layer 7. The substrate 5 preferably has a mechanical strength to a extent that it can be handled without causing problems even under a heating condition during thermal transfer printing. When the image-receiving sheet is used as a picture postcard, the substrate 5 should have a suitable rigidity for this use.

The use of the material for forming the substrate 5, which has the above-described properties suffices, and representative examples of the material therefor may include paper such as fine paper, art paper, coated paper, cast-coated paper and postcard paper; processed paper such as synthetic resin-impregnated paper, emulsion-impregnated paper, synthetic rubber-latex-impregnated paper, paper backed with synthetic resin; synthetic paper such as plastic laminate paper, polyolefin paper and polystyrene paper; and a film or sheet of plastic material such as polyester, polyacrylate, polycarbonate, polyurethane, polyimide, polyetherimide, cellulose derivative, polyethylene, ethylene-vinylacetate copolymers, polypropylene, polystyrene, polyacrylonitrile, polyvinyl chloride, polyvinylidene chloride, polyvinyl alcohol, polyvinyl butyral, nylon, polyether ehterketone, polysulfone, polyethersulfone, tetrafluoroethylene-(perfluoroalkyl) vinylether copolymers, polyvinyl fluoride, tetrafluoroethylene-ethylene copolymers, tetrafluoroethylene-hexafluoropropylene copolymers, polychlorotrifluoroethylene and polyvinylidene fluoride. The material for forming the substrate 5 is note specially limited to the above-mentioned materials.

As the substrate 5, there may be used a white opaque film formed by adding a white pigment and a filler to the above-mentioned plastic, or a foamed sheet obtained by foaming such plastic.

The substrate 5 may comprise a laminated body of the combination of layers of materials optionally selected from the materials described above. In this case, representative examples thereof may include a laminated body of cellulose fiber paper and synthetic paper, another laminated body of cellulose fiber paper and a plastic film or sheet, and further another laminated body of plastic films or sheets which are different from each other in kind and grade. Such a laminated body may have a two-layers construction. However, there may be used a laminated body having a three or more-layers construction which is obtained by using a coated paper or a white or transparent plastic film as a core material, and adhering synthetic papers or foamed plastic films onto the both surface of the core material.

It is preferable to limit the thickness of the substrate 5 within a range of from about 50 to about 800 $\mu$m, however the thickness thereof is not limited only thereto.

If the substrate 5 has a poor adhesiveness to the layer to be formed thereon, a corona discharging treatment, a plasma treatment or any kind of primer coating methods may be applied to the surface of the substrate 5.

Color receptor layer

In the image-receiving sheet for thermal transfer printing of the present invention, the color receptor layer 6 formed on the one surface of the substrate 5 has functions of receiving coloring agents such as sublimative dye which is transferred from a thermal transfer sheet, and keeping the formed image. Materials for forming the color receptor layer 6 are appropriately selected depending on coloring agent to be used. There may be used, as the materials for forming the color receptor layer 6, any kind of known materials for forming a color receptor layer for thermal transfer printing methods such as a sublimation type thermal transfer printing method and the like.

A dye-permeable release agent may be contained in the color receptor layer 6 or a dye-permeable release layer may be formed on the color receptor layer 6, in order to impart a releasability to the color receptor layer 6 to an extent that it is possible to prevent the color receptor layer 6 and the thermal transfer sheet from being heat-fused to each other. In this case, certain kind of additives such as pigment and the like may be added to the color receptor layer 6.

An applied amount of the color receptor layer 6 is preferably within a range of from about 2.5 to 5.0 g/m$^2$ in a solid content.

At least one intermediate layer 9*a* may be formed between the color receptor layer 6 and the substrate 5. The "intermediate layer" means all of the layers between the color receptor layer 6 and the substrate 5, such as an adhesive layer (primer layer), a white coloring layer, a barrier layer, an ultraviolet rays-absorbing layer, a foamed layer and an electrification preventing layer. Any kind of known intermediate layer may be applied, if necessary.

If the substrate 5 can per se receive the coloring agents and keep stably them thus received, the surface of such a substrate 5, which has a good coloring agents-receiving property, may act as a color receptor layer 6. Such an embodiment is within a scope of the present invention.

Back surface layer

The image-receiving sheet for thermal transfer printing of the present invention may be used not only as a normal image-receiving sheet, but also as a picture postcard, and the back surface layer 7 has characterizing features. More specifically, the back surface layer 7 has an excellent writing property with the use of any kind of graphite-type writing means generally used such as a pencil, a mechanical pencil and the like, aqueous-ink type writing means such as a fountain pen, an aqueous-ink type pen and the like, and oil-ink type writing means such as a ball-point pen, an oil-ink type pen and the like, and has a good stamp adhesion property, and has no problem of the transfer of the dye or the like to the back surface of the image-receiving sheet, even when the image-receiving sheets are stacked and stored so that the color receptor layer of the image-receiving sheet comes into contact with the back surface layer of the other image-receiving sheet.

The back surface layer 7 comprises thermoplastic resin and hydrophilic porous microsilica which is obtained by a wet process and has a pore volume of from 0.2 to 3.0 ml/g. The microsilica is dispersed into the thermoplastic resin as a binder.

Any kind of known thermoplastic resins may be used as a binder for the back surface layer 7. The thermoplastic resin with a low dyeing affinity has a function of improving the resistance property to stain of the back surface layer 7 by coloring agent such as dye and the like, in addition to the function as a binder. It is preferable to use polyvinylbutyral as a binder in order to improve the stain-resistance of the back surface layer 7, and it is further preferable to use at least one selected from the group consisting of isocyanate compounds and chelating agents as a hardening agent, together with polyvinylbutyral.

In the present invention, the hydrophilic porous microsilica is dispersed into the back surface layer 7. The microsilica is obtained by a wet process and has a pore volume of from 0.2 to 3.0 ml/g.

It is possible to manufacture the microsilica by means of a dry process. According to the dry process, the microsilica can be obtained by, for example, burning silicon tetrachloride in a gas phase to hydrolyze same. However, the microsilica thus obtained by means of the dry process has no pore in the inside of its particles, and therefore has no inner surface area. Such kind of silica has a low water-absorbability, and is not therefore suitable for the use as in the present invention, in which a high hydrophilicity or a high water-absorbability is required.

On the contrary, according to the wet process (gelation process), the microsilica can be obtained by, for example, causing the reaction of an aqueous solution of sodium silicate with sulfuric acid or hydrochloric acid to produce silica sol, and causing the thus produced silica sol to gel. The thus obtained by means of the wet process is porous and has on the surface thereof the silanol group (—SiOH) as a hydrophilic functional group. Such microsilica has higher hydropilicity and water-absorbability than those of a normal hydrophilic filler, and is therefore suitable for improvement of a writing property with the use of an aqueous-ink type pen and a stamp adhesion property.

Hydrophilic porous microsilica obtained by the wet process may not be suitable for a certain use outside the scope of the present invention. In the light of this fact, there also exists silica which is obtained by manufacturing hydrophilic porous microsilica by means of the wet process, and then applying a surface treatment to the thus manufactured microsilica with the use of organic or inorganic material so as to decrease its hydrophilicity. However, in the present invention, the microsilica having a high hydrophilicity is of importance, and it is therefore preferable to use the microsilica as manufactured by means of the wet process, without subjecting same to the above-mentioned surface treatment.

In the present invention, there is used the microsilica having the pore volume of from 0.2 to 3.0 ml/g as described above. The pore volume of the microsilica is a parameter for showing the porosity thereof. The "pore volume" means a total volume of pores existing in a porous material. The pore volume can for example be determined in a manner described below. First, a container having a known capacity is filled with porous particles. Then, dead space is determined by further filling this container which has been filled with the particles, with a helium gas and measuring an amount of helium gas supplied into the container, thus permitting the measurement of the total amount of the pore volume and the space volume between the particles. Then, the helium gas is discharged from the container, and different dead space is determined by further filling this container which has been filled with the particles, with mercury and measuring an amount of mercury supplied into the container, thus permitting the measurement of the only space volume between the particles, since the mercury does not permeate into the pores of the porous particles due to its non-wettability against a solid. Then, the pore volume can be determined by subtracting the dead space determined with the use of the helium gas and the different dead space determined with the use of the mercury.

In general, the inner surface area of the microsilica becomes larger and an amount of the silanol group per unit volume is increased, according as the pore volume thereof becomes larger. As a result, the hydrophilicity and the water-absorbability of the microsilica are increased, and the fixation of an aqueous ink of a fountain pen, an aqueous-ink type pen, or the like, and the stamp adhesion property can preferably be improved. With a pore volume of the microsilica of over 3.0 ml/g, the hydrophilicity thereof however becomes too high, thus leading to blots of an queous ink, and each of pores in the microsilica particles is enlarged, thus leading to decrease in rigidity of the back surface layer 7 and degradation of the writing property with the use of a graphite-type writing means.

With a pore volume of the microsilica of under 0.2 ml/g, on the other hand, the hydrophilicity and the water-absorbability of the microsilica are decreased, thus leading to degradation of the fixation of an aqueous ink, and deterioration of a stamp adhesion property, although there is obtained sufficient rigidity of the back surface layer 7, resulting in good writing property with the use of a graphite-type writing means.

In the present invention, there may be used a single kind of hydrophilic porous microsilica having a pore volume within a range of from 0.2 to 3.0 ml/g, which has been obtained by a wet process. It is however preferable to prepare plural kinds of hydrophilic porous microsilica having different pore volume within a range of from 0.2 to 0.9 ml/g (hereinafter referred to as the "group A"), as well as the other plural kinds of hydrophilic porous microsilica having different pore volume within a range of from 1.2 to 3.0 ml/g (hereinafter referred to as the "groups B"), and use the combination of at least one kind of the group A with at least one kind of the group B. The use of the combination of at least one kind of the group A having a smaller pore volume distribution with at least one kind of the group B having a larger pore volume distribution, makes it possible to keep the proper balance of pore volume distribution, thereby permitting exhibition of the respective kinds of microsilica. As a result, it is possible to impart more excellent properties of all of the writing property with the use of an aqueous-ink type writing means, the stamp adhesion property and the writing property with the use of a graphite-type writing means, to the back surface of the image-receiving sheet for thermal transfer printing.

More specifically, the hydrophilic porous microsilica having a small pore volume within a range of from 0.2 to 0.9 ml/g has a sufficient rigidity to impart an excellent writing property with the use of a graphite-type writing means, to the back surface of the image-receiving sheet, and also has the hydrophilicity and the water-absorbability which are higher than those of a normal hydrophilc filler, thus permitting the improvement of the writing property with the use of an aqueous-ink type writing means and the stamp adhesion property.

On the other hand, the hydrophilic porous microsilica having a large pore volume within a range of from 1.2 to 3.0 ml/g has a high hydrophilicity and a high water-absorbability, thus permitting the improvement of the writing property with the use of an aqueous-ink typewriting means and the stamp adhesion property, whereas the rigidity of the back surface layer is slightly decreased, resulting in the tendency that the writing property with the use of a graphite-type writing means may slightly be deteriorated.

The above-mentioned microsilica may preferably have an average particle size of from 0.5 to 15 $\mu$m. It is more preferable to limit the particle size thereof within a range of from 0.5 to 5 $\mu$m. With an average particle size of the microsilica of under 0.5 $\mu$m, the writing property with the use of a graphite-type writing means may be deteriorated. With an average particle size of the microsilica of over 15 $\mu$m, there may easily occur blots of an queous ink upon using an queous-ink type writing means, and coefficient of friction of the bach surface of the image-receiving sheet may be increased, thus leading to degradation of property that the image-receiving sheet can smoothly be carried through a printer.

With respect to an amount of microsilica to be added to thermoplastic resin, a weight ratio of microsilica/thermoplastic resin may preferably be within a range of from 0.1 to 3.0.

With a weight ratio thereof under 0.1, a sufficient writing property and a sufficient stamp adhesion property may not easily be obtained. With a weight ratio thereof over 3.0, on the other hand, an applying property of a coating material for forming the back surface layer may be degraded, and a layer strength may also be decreased, with the result that the writing using any writing means may easily cause the occurrence of peeling of the back surface layer.

It is advisable to add a particulate lubricative filler having a larger particle size than that of the above-mentioned microsilica, to the back surface layer 7, to decrease coefficient friction of the back surface of the image-receiving sheet, in order to improve the property that the image-receiving sheet can smoothly be carried through a printer, and prevent plural pieces of image-receiving sheets from being supplied into the printer. The particulate lubricative filler preferably has an average particle size of from 1.0 to 30 $\mu$m. It is further preferable to limit the lower limit of its average particle size to 2 $\mu$m and/or the upper limit thereof to 15 $\mu$m. Nylon particulate filler may preferably be used as the particulate lubricative filler.

It may be preferable to limit an applied amount of the coating material for forming the back surface layer 7 within a range of from 0.5 to 5.0 g/m$^2$ in a solid content, in order to sufficiently exhibit the functions of the back surface layer 7.

With an applied amount thereof under 0.5 g/m$^2$, an amount of microsilica is also decreased, with the result that a sufficient writing property and a sufficient stamp adhesion property may not be obtained. With an applied amount thereof over 5 g/m$^2$, different effects are not be expected, and there may be caused an adverse effect of increase in cost of material and manufacturing cost, thus leading to unfavorable problems.

The above-mentioned back surface layer 7 is directly formed on the substrate 5. However, there may be formed between the substrate 5 and the back surface layer 7, an intermediate layer 9*b* which comprises resin having excellent adhesiveness to both of these layers. It is possible to add additives comprising a white or other coloring pigment such as titanium oxide, calcium carbonate, a fluorescent whitening agent, and the like, if necessary.

The same layer as the known intermediate layer formed between the substrate 5 and the color receptor layer 6 may be formed between the substrate 5 and the back surface layer 7 in the same manner.

Release layer

In the present invention, a release layer 8 may be formed on the above-mentioned back surface layer 7 so that the image-receiving sheet can smoothly pass through a printer without causing the heat-fusing of the back surface of the image-receiving sheet and an ink layer of the thermal transfer sheet, even when the image-receiving sheet is inadvertently supplied upside down into the printer.

The release layer should have properties of not being heat-fused with the ink layer of the thermal transfer sheet, being unstainable against dye, and not detracting characteristics required for a postcard, such as the writing property on the back surface layer, the stamp adhesion property, and the like. In order to obtain these properties, it is preferable to coat the back surface layer 7 with a thin layer having a thickness of from 0.01 to 1.0 $\mu$m, which comprises resin having a releasing property such as polyvinyl alcohol (hereinafter referred to as the "PVA"), cellulose acetate or the like.

With a thickness of the release layer 8 of under 0.01 $\mu$m, a sufficient releasing effect may not be obtained. With a thickness thereof of over 1.0 $\mu$m, on the other hand, a sufficient writing property and a sufficient stamp adhesion property may not be obtained.

It is preferable to use, as resin for the release layer 8, resin having the hydrophilicity such as PVA, so as to exhibit the above-described properties and improve the fixation of an aqueous ink of an aqueous-ink type pen and a fountain pen.

When there is used the PVA having an excessively high saponification degree or having an excessively low polymerization degree, a water-resisting property of the release layer 8 is degraded, thus causing a problem of peeling of the back surface layer 7 due to an aqueous ink, upon writing with the use of an aqueous-ink type pen or the like. When there is used the PVA having an excessively low saponification degree, a sufficient releasing property may not be obtained. When there is used the PVA having an excessively high polymerization degree, an applying property may be degraded. For these reasons, the PVA preferably has a polymerization degree of from 500 to 3,000 and a saponification degree of from 50 to 95 molar %. The saponification degree (%) is defined as a following formula:

$$\frac{(\text{number of hydroxyl groups in a resin}) \times 100}{\left(\begin{array}{c}\text{Total number of ester groups capable of the saponification}\\ \text{in a resin and hydroxyl groups in the same}\end{array}\right)}$$

Each of the layers of the image-receiving sheet for thermal transfer printing, which are made of the above-described materials, can be formed by dissolving or dispersing the above-described material for each of the layers in a solvent to prepare a coating material, then applying the thus prepared coating material in a required amount onto the surface of the substrate 5 by means of any one of known forming methods such as a gravure coating, a roll coating, a blade coating, a knife coating, a micro-bar coating, a wire-bar coating, a spray coating and the like, and then drying same. The applying method is not especially limited only to the above-mentioned methods, and an appropriate method may optionally be selected.

On the back surface of the printed material obtained by conducting the thermal transfer printing onto the image-receiving sheet of the present invention, it is possible to write easily with the use of any one of an aqueous-ink type writing means and a graphite-type writing means, without causing any problems. The back surface of the above-mentioned printed material also has an excellent stamp adhesion property. The printed material can therefore be used as a picture postcard without causing any problems.

Figure 5:
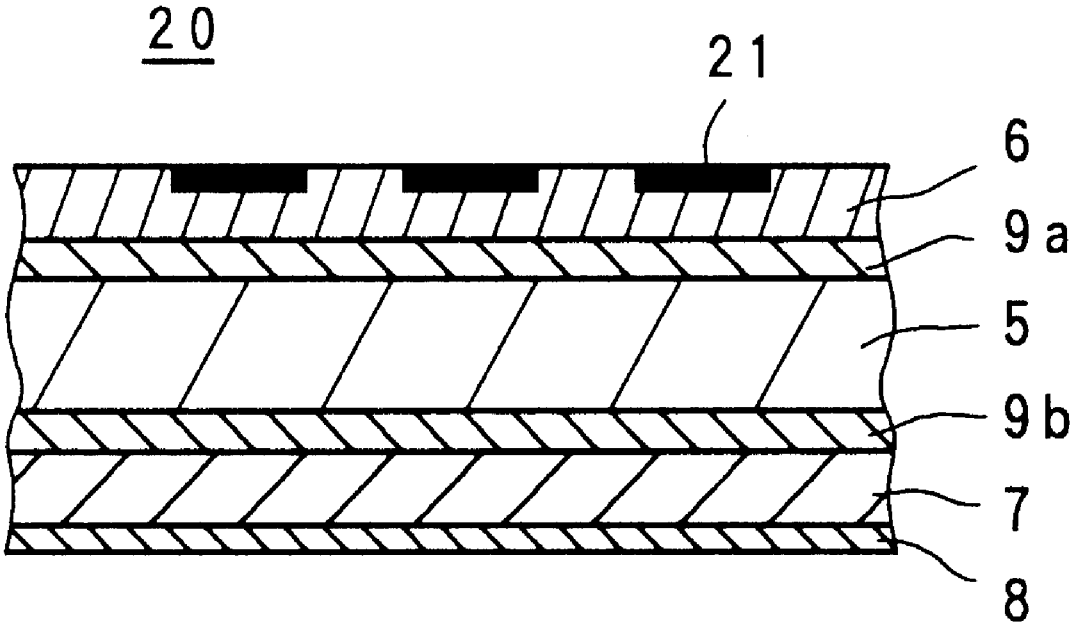
FIG. 5 is a schematic sectional view illustrating an embodiment of the printed material of the present invention.

An embodiment of such a printed material is shown in FIG. 5. In FIG. 5, the printed material 20 is obtained by conducting the thermal transfer printing onto the image-receiving sheet 4 as shown in FIG. 4. The color receptor layer 6 of the printed material 20 has printing information 21 recorded thereon such as characters, image or the like.

EXAMPLES

Now, the present invention will be described hereinbelow in more detail with reference to the following Experiment Examples A to C. In these examples, there were used microsilica, nylon filler and polyvinyl alcohol (PVA) listed in any one of the following Tables 1 to 3.

TABLE 1

| Microsilica | Pore volume (ml/g) | Average particle size ($\mu$m) |
|---|---|---|
| SYLYSIA 250 | 1.80 | 2.5 |
| SYLYSIA 310 | 1.60 | 1.4 |
| SYLYSIA 550 | 0.80 | 2.7 |
| SYLYSIA 730 | 0.44 | 3.0 |
| P-73 | 0.80 | 2.5 |

TABLE 2

| Nylon filler | Average particle size ($\mu$m) |
|---|---|
| MW-330 | 5 |

TABLE 3

| PVA | Saponification degree (mol. %) | Polymerization degree |
|---|---|---|
| GOHSENOL GH-14 | 86.5–89.0 | 1400 |
| GOHSENOL GH-20 | 86.5–89.0 | 2000 |
| GOHSENOL KH-17 | 78.5–81.5 | 1700 |
| GOHSENOL KH-20 | 78.5–81.5 | 2000 |

Experiment Example A

Experiment Example A-1

A synthetic paper having a thickness of 150 $\mu$m ("YUPO FPG#150" manufactured by Ohji Yukago Seishi K.K.) was used as a substrate. A coating material for forming a back surface layer having the following composition was applied onto one surface of the substrate in an applied amount of 2.0 g/m$^2$ (in solid content) by means of the roll coating method, and the thus applied coating material was dried to form the back surface layer. Then, a coating material for forming a front surface-side intermediate layer was applied onto the other surface of the substrate in an applied amount of 2.0 g/m$^2$ (in solid content) in the same manner as mentioned above, and the thus applied coating material was dried to form the front surface-side intermediate layer. Then, a coating material for forming a color receptor layer was applied onto the thus formed front surface-side intermediate layer in an applied amount of 5.0 g/m$^2$ (in solid content) in the same manner as mentioned above, and the thus applied coating material was dried to form the color receptor layer, thereby preparing an image-receiving sheet for thermal transfer printing (hereinafter referred to as the "Experiment Example A-1").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 2.0 g/m$^2$ (applied amount)

Composition of the coating material for forming the back surface layer:

1̂ Polyurethane (HMS-20 manufactured by Nihon Polyurethane Kogyo K.K.): 50 wt. parts 2̂ Microsilica (SYLYSIA 550 manufactured by Fuji Shirishia K.K.): 50 wt. parts 3̂ Solvent (toluene/isopropyl alcohol having a weight ratio of 1:1): 400 wt. parts (isopropyl alcohol is hereinafter referred to as "IPA")

Composition of the coating material for forming the front surface-side intermediate layer:

1̂ Polyurethane (N-5199 manufactured by Nihon Polyurethane Kogyo K.K.): 50 wt. parts 2̂ Titanium oxide (TCA-888 manufactured by Tochem Product): 50 wt. parts 3̂ Solvent (toluene/methyl ethyl ketone having a weight ratio of 1:1): 400 wt. parts (methyl ethyl ketone is hereinafter referred to as "MEK")

Composition of the coating material for forming the color receptor layer:

1̂ Vinyl chloride-vinyl acetate copolymer (#1000A manufactured by Denki Kagaku K.K.): 75 wt. parts 2̂ Polyester Bylon 600 manufactured by Toyobo K.K.): 25 wt. parts 3̂ Catalyst-hardening type silicone (X62-1212 manufactured by Shinetsu Kagaku Kogyo K.K.): 6 wt. parts 4̂ Platinum catalyst (PL-50T manufactured by Shinetsu Kagaku Kogyo K.K.): 3 wt. parts 5̂ Solvent (toluene/MEK having a weight ratio of 1:1): 400 wt. parts Experiment Example A-2

There was obtained the same structure as that in the image-receiving sheet of the Experiment Example A-1, which comprised the substrate, the front surface-side intermediate layer and the color receptor layer, a back surface-side intermediate layer was newly formed between the substrate and the back surface layer, and the material for forming the back surface layer was changed.

More specifically, a coating material for forming a back surface-side intermediate layer having the following composition was applied onto one surface of the substrate which comprised a synthetic paper having a thickness of 150 $\mu$m in an applied amount of 1.0 g/m$^2$ (in solid content) by means of the roll coating method, and the thus applied coating material was dried to form the back surface-side intermediate layer. Then, a coating material for forming the back surface layer having the following composition was applied onto the thus prepared back surface-side intermediate layer in an applied amount of 2.0 g/m$^2$ (in solid content) in the same manner, and the thus applied coating material was dried to form the back surface layer.

Then, the same front surface-side intermediate layer and color receptor layer as those in the image-receiving sheet of the Experiment Example A-1 were formed in this order and in the same manner on the other surface of the substrate, thereby preparing an image-receiving sheet for thermal transfer printing (hereinafter referred to as the "Experiment Example A-2").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface-side intermediate layer: 1.0 g/m$^2$ (applied amount)

Back surface layer: 2.0 g/m$^2$ (applied amount)

Composition of the coating material for forming the back surface-side intermediate layer:

1̂ Polyurethane (N-5199 manufactured by Nihon Polyurethane Kogyo K.K.): 50 wt. parts 2̂ Titanium oxide (TCA-888 manufactured by Tochem Product): 50 wt. parts 3̂ Solvent (toluene/MEK having a weight ratio of 1:1): 400 wt. parts Composition of the coating material for forming the back surface layer:

1̂ Polyvinyl butyral (#5000-A manufactured by Denki Kagaku Kogyo K.K.): 50 wt. parts 2̂ Microsilica (SYLYSIA 550 manufactured by Fuji Shirishia Kagaku K.K.): 50 wt. parts 3̂ Solvent (toluene/IPA having a weight ratio of 1:1): 400 wt. parts Experiment Example A-3

The same steps as those for preparing the image-receiving sheet of the Experiment Example A-1 were carried out except that the coating material for forming the back surface layer was changed to a coating material having the following composition and an applied amount thereof was changed to 3.0 g/m$^2$, thereby preparing an image-receiving sheet for thermal transfer printing (hereinafter referred to as the "Experiment Example A-3"), Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 3.0 g/m$^2$ (applied amount)

Composition of the coating material for forming the back surface layer:

1̂ Polyvinyl butyral (#3000-1 manufactured by Denki Kagaku Kogyo K.K.): 40 wt. parts 2̂ Microsilica (SYLYSIA 250 manufactured by Fuji Shirishia Kagaku K.K.): 50 wt. parts 3̂ Isocyanate compound (TAKENATE D-160N manufactured by Takeda Yakuhin Kogyo K.K.): 10 wt. parts 4̂ Solvent (toluene/IPA having a weight ratio of 1:1): 400 wt. parts Experiment Example A-4

The same steps as those for preparing the image-receiving sheet of the Experiment Example A-2 were carried out except that the coating material for forming the back surface layer was changed to a coating material having the following composition and an applied amount thereof was changed to 2.5 g/m$^2$, thereby preparing an image-receiving sheet for thermal transfer printing (hereinafter referred to as the "Experiment Example A-4").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface-side intermediate layer: 1.0 g/m$^2$ (applied amount)

Back surface layer: 2.5 g/m$^2$ (applied amount)

Composition of the coating material for forming the back surface layer:

1̂ Polyvinyl butyral (#3000-1 manufactured by Denki Kagaku Kogyo K.K.): 30 wt. parts 2̂ Microsilica (SYLYSIA 730 manufactured by Fuji Shirishia Kagaku K.K.): 60 wt. parts 3̂ Nylon filler (MW-330 manufactured by Shinto Toryo K.K.): 5 wt. parts 4̂ Solvent (toluene/IPA having a weight ratio of 1:1): 400 wt. parts Experiment Example A-5

The same steps as those for preparing the image-receiving sheet of the Experiment Example A-1 were carried out except that the coating material for forming the back surface layer was changed to a coating material having the following composition and an applied amount thereof was changed to 3.5 g/m$^2$, thereby preparing an image-receiving sheet for thermal transfer printing (hereinafter referred to as the "Experiment Example A-5").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 3.5 g/m$^2$ (applied amount)

Composition of the coating material for forming the back surface layer:

1̂ Polyvinyl butyral (#5000-A manufactured by Denki Kagaku Kogyo K.K.): 30 wt. parts 2̂ Microsilica (SYLYSIA 250 manufactured by Fuji Shirishia Kagaku K.K.): 60 wt. parts 3̂ Chelating agent (ORGATIX TC-750 manufactured by Matsumoto Seiyaku K.K.): 5 wt. parts 4̂ Nylon filler (MW-330 manufactured by Shinto Toryo K.K.): 5 wt. parts 5̂ Solvent (toluene/IPA having a weight ratio of 1:1): 400 wt. parts Experiment Example A-6

The same steps as those for preparing the image-receiving sheet of the Experiment Example A-5 were carried out except that the coating material for forming the back surface layer was changed to a coating material having the following composition, thereby preparing an image-receiving sheet for thermal transfer printing (hereinafter referred to as the "Experiment Example A-6").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 3.5 g/m$^2$ (applied amount)

Composition of the coating material for forming the back surface layer:

1̂ Polyvinyl butyral (#5000-A manufactured by Denki Kagaku Kogyo K.K.): 30 wt. parts 2̂ Microsilica (P-73 manufactured by Mizusawa Kagaku Kogyo K.K.): 60 wt. parts 3̂ Chelating agent (ORGATIX TC-750 manufactured by Matsumoto Seiyaku K.K.): 5 wt. parts 4̂ Nylon filler (MW-330 manufactured by Shinto Toryo K.K.): 5 wt. parts 5̂ Solvent (toluene/IPA having a weight ratio of 1:1): 400 wt. parts Comparison Example a-1

The same steps as those for preparing the image-receiving sheet of the Experiment Example A-1 were carried out except that the coating material for forming the back surface layer was changed to a coating material having the following composition, thereby preparing an image-receiving sheet for thermal transfer printing (hereinafter referred to as the "Comparison Example a-1").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 2.0 g/m$^2$ (applied amount)

Composition of the coating material for forming the back surface layer:

1̂ Polyurethane (HMS-20 manufactured by Nihon Polyurethane Kogyo K.K.): 50 wt. parts 2̂ Calcium carbonate (HAKUENKA PZ manufactured by Shiraishi Kogyo K.K.): 50 wt. parts 3̂ Solvent (toluene/IPA having a weight ratio of 1:1): 400 wt. parts Tests and results For each of samples of the Experiment Examples A-1 to A-5 and the Comparison Example a-1 prepared as mentioned above, the following tests were carried out. Results of these tests are shown in Table 4.

1) Writing property of the back surface of the image-receiving sheet

Characters were written on the back surface of the sample of the image-receiving sheet with the use of the following writing means, and the writing property was evaluated on the basis of the following criteria.

Writing means as used a) Pencil: "Mitsubishi Office Pencil No. 9800 HB" (manufactured by Mitsubishi Pencil Co. Ltd.)

b) Aqueous ink-type pen: "Pentel Sign Pen" (black) (manufactured by Pentel Co. Ltd.)

c) Oil ink-type pen: "Magic Ink No. 700" (black) (manufactured by Teranishi Chemical Co. Ltd.)

d) Ball point pen: "Jimny" (black) (manufactured by Zebra Co. Ltd.)

Criteria

○: Smooth writing with sufficient depth was permitted, the characters were readable without causing blots, and an excellent fixation was recognized.

Δ: The characters were so slightly dim and dull that they could not easily be read.

X: The characters disappeared only by giving a small rub with a finger, after the lapse of time of 12 hours.

2) Stamp adhesion property of the back surface of the image-receiving sheet

Water was applied onto the entire adhesive surface of the Japanese postage stamp of ¥50.—with a finger, and this stamp was stuck on the back surface of the sample of the image-receiving sheet. The sample was left along for 12 hours, and the stamp adhesion property was evaluated on the basis of the following criteria:

○: The stamp was not peeled after the laps of time of 12 hours.

X: The stamp was easily peeled with fingers after the laps of time of 12 hours.

3) Dye stain resistance of the back surface of the image-receiving sheet

With the use of a thermal transfer sheet and a sublimation printing type printer, thermal transfer printing was conducted to print a black ground all over the image-receiving surface of each of two pieces of the same sample of the image-receiving sheet. One piece of the sample was laid on the other piece of sample so that the back surface of the former come into contact with the image-receiving surface having the black ground of the latter. These two pieces of the sample were placed between two pieces of flat aluminum plate, and they are pressed under the load of 20 gf/cm$^2$, and then stored in a thermo-hygrostat having a temperature of 40° C. and a relative humidity of 90% for the period of time of 120 hours while keeping the thus pressed condition. Then, the transfer of the dye from the image-receiving surface of the lower piece to the back surface of the upper piece was investigated by an optical inspection, and evaluated on the basis of the following criteria:

○: Almost no transfer of the dye was found.

Δ: There was found a slight transfer of the dye, however causing no practical problems.

X: Transfer of the dye was found.

Thermal transfer sheet

The thermal transfer sheet "VY-SS30" manufactured by Hitachi Co. Ltd.

Printer

The color video printer "VY-P1" manufactured by Hitachi Co. Ltd.

TABLE 4

| | writing property | | | | | |
|---|---|---|---|---|---|---|
| | Pen-cil | Aqueous-ink type pen | Oil-ink type pen | Ball point pen | Stamp adhesion property | Dye stain re-sistance |
| Experiment Example A-1 | ○ | ○ | ○ | ○ | ○ | Δ |
| Experiment Example A-2 | ○ | ○ | ○ | ○ | ○ | Δ |
| Experiment Example A-3 | ○ | ○ | ○ | ○ | ○ | ○ |
| Experiment Example A-4 | ○ | ○ | ○ | ○ | ○ | ○ |
| Experiment Example A-5 | ○ | ○ | ○ | ○ | ○ | ○ |
| Experiment Example A-6 | ○ | ○ | ○ | ○ | ○ | ○ |
| Comparison Example a-1 | Δ | X | ○ | Δ | X | X |

As is clear from the evaluation results shown in Table 4, the Comparison Example a-1 was poor in any one of the writing property, the stamp adhesion property and the dye stain resistance, thus revealing unfavorable problems.

On the contrary, any one of the Experiment Examples A-1 to A-6 were excellent in the writing property with the use of any kind of the writing means as well as in the stamp adhesion property. With respect to the dye stain resistance, almost no transfer of the dye was found or there was found a slight transfer of the dye, however causing no practical problems, thus revealing good results.

Experiment Example B

Experiment Example B-1

A synthetic paper having a thickness of 150 μm ("YUPO FPG#150" manufactured by Ohji Yukagoseishi K.K.) was used as a substrate. A coating material for forming a back surface layer having the following composition was applied onto one surface of the substrate in an applied amount of 2.0 g/m$^2$ (in solid content) by means of the roll coating method, and the thus applied coating material was dried to form the back surface layer. Then, a coating material for forming a front surface-side intermediate layer was applied onto the other surface of the substrate in an applied amount of 2.0 g/m$^2$ (in solid content) in the same manner as mentioned above, and the thus applied coating material was dried to form the front surface-side intermediate layer. Then, a coating material for forming a color receptor layer was applied onto the thus formed front surface-side intermediate layer in an applied amount of 5.0 g/m$^2$ (in solid content) in the same manner as mentioned above, and the thus applied coating material was dried to form the color receptor layer, thereby preparing an image-receiving sheet for thermal transfer printing (hereinafter referred to as the "Experiment Example B-1").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 μm

Back surface layer: 2.0 g/m$^2$ (applied amount)

Composition of the coating material for forming the back surface layer:

1̂ Polyurethane (HMS-20 manufactured by Nihon Polyurethane Kogyo K.K.): 50 wt. parts 1̂ Microsilica (SYLYSIA 250 manufactured by Fuji Shirishia Kagaku K.K.): 50 wt. parts 3̂ Microsilica (SYLYSIA 550 manufactured by Fuji Shirishia Kagaku K.K.): 50 wt. parts 4̂ Solvent (toluene/IPA having a weight ratio of 1:1): 600 wt. parts Composition of the coating material for forming the front surface-side intermediate layer:

1̂ Polyurethane (N-5199 manufactured by Nihon Polyurethane Kogyo K.K.): 50 wt. parts 2̂ Titanium oxide (TCA-888 manufactured by Tochem Product): 50 wt. parts 3̂ Solvent (toluene/MEK having a weight ratio of 1:1): 400 wt. parts Composition of the coating material for forming the color receptor layer:

1̂ Vinyl chloride-vinyl acetate copolymer (#1000A manufactured by Denki Kagaku Kogyo K.K.): 75 wt. parts 2̂ Polyester (BAYLON 600 manufactured by Toyobo K.K.): 25 wt. parts 3̂ Catalyst-hardening type silicone (X62-1212 manufactured by Shinetsu Kagaku Kogyo K.K.): 6 wt. parts 4̂ Platinum catalyst (PL-50T manufactured by Shinetsu Kagaku Kogyo K.K.): 3 wt. parts 5̂ Solvent (toluene/MEK having a weight ratio of 1:1): 400 wt. parts Experiment Example B-2

There was obtained the same structure as that in the image-receiving sheet of the Experiment Example A-1, which comprised the substrate, the front surface-side intermediate layer and the color receptor layer, a back surface-side intermediate layer was newly formed between the substrate and the back surface layer, and the material for forming the back surface layer was changed.

More specifically, a coating material for forming a back surface-side intermediate layer having the following composition was applied onto one surface of the substrate which comprised a synthetic paper having a thickness of 150 $\mu$m in an applied amount of 1.0 g/m$^2$ (in solid content) by means of the roll coating method, and the thus applied coating material was dried to form the back surface-side intermediate layer. Then, a coating material for forming the back surface layer having the following composition was applied onto the thus prepared back surface-side intermediate layer in an applied amount of 2.0 g/m$^2$ (in solid content) in the same manner, and the thus applied coating material was dried to form the back surface layer.

Then, the same front surface-side intermediate layer and color receptor layer as those in the image-receiving sheet of the Experiment Example B-1 were formed in this order and in the same manner on the other surface of the substrate, thereby preparing an image-receiving sheet for thermal transfer printing (hereinafter referred to as the "Experiment Example B-2").

Structure of the image-receiving sheet for thermal transfer printing:

Color receptor layer: 5.0 g/m$^2$ (applied amount)

Front Surface-side intermediate layer: 2.0 g/m$^2$ (applied amount)

Substrate: a synthetic paper having a thickness of 150 $\mu$m

Back surface-side intermediate layer: 1.0 g/m$^2$ (applied amount)

Back surface layer: 2.0 g/m$^2$ (applied amount)

Composition of the coating material for forming the back surface-side intermediate layer:

1̂ Polyurethane (N-5199 manufactured by Nihon Polyurethane Kogyo K.K.): 50 wt. parts 2̂ Titanium oxide (TCA-888 manufactured by Tochem Product): 50 wt. parts 3̂ Solvent (toluene/MEK having a weight ratio of 1:1): 400 wt. parts Composition of the coating material for forming the back surface layer:

1̂ Polyvinyl butyral (#5000-A manufactured by Denki Kagaku Kogyo K.K.): 50 wt. parts 2̂ Microsilica (SYLYSIA 730 manufactured by Fuji Shirishia Kagaku K.K.): 50 wt. parts 3̂ Microsilica (SYLYSIA 250 manufactured by Fuji Shirishia Kagaku K.K.): 25 wt. parts 4̂ Solvent (toluene/IPA having a weight ratio of 1:1): 500 wt. parts Experiment Example B-3

The same steps as those for preparing the image-receiving sheet of the Experiment Example B-1 were carried out except that the coating material for forming the back surface layer was changed to a coating material having the following composition and an applied amount thereof was changed to 3.0 g/m$^2$, thereby preparing an image-receiving sheet for thermal transfer printing (hereinafter referred to as the "Experiment Example B-3").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 3.0 g/m$^2$ (applied amount)

Composition of the coating material for forming the back surface layer:

1̂ Polyvinyl butyral (#3000-1 manufactured by Denki Kagaku Kogyo K.K.): 40 wt. parts 2̂ Microsilica (SYLYSIA 730 manufactured by Fuji Shirishia Kagaku K.K.): 50 wt. parts 3̂ Microsilica (SYLYSIA 250 manufactured by Fuji Shirishia Kagaku K.K.): 50 wt. parts 4̂ Isocyanate compound (TAKENATE D-160N manufactured by Takeda Yakuhin Kogyo K.K.): 10 wt. parts 5̂ Solvent (toluene/IPA having a weight ratio of 1:1): 560 wt. parts Experiment Example B-4

The same steps as those for preparing the image-receiving sheet of the Experiment Example B-2 were carried out except that the coating material for forming the back surface layer was changed to a coating material having the following composition and an applied amount thereof was changed to 2.5 g/m$^2$, thereby preparing an image-receiving sheet for thermal transfer printing (hereinafter referred to as the "Experiment Example B-4").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface-side intermediate layer: 1.0 g/m$^2$ (applied amount)

Back surface layer: 2.5 g/m$^2$ (applied amount)

Composition of the coating material for forming the back surface layer:

1̂ Polyvinyl butyral (#3000-1 manufactured by Denki Kagaku Kogyo K.K.): 30 wt. parts 2̂ Microsilica (SYLYSIA 730 manufactured by Fuji Shirishia Kagaku K.K.): 60 wt. parts 3̂ Microsilica (SYLYSIA 310 manufactured by Fuji Shirishia Kagaku K.K.): 30 wt. parts 4̂ Nylon filler (MW-330 manufactured by Shinto Toryo K.K.): 5 wt. parts 5̂ Solvent (toluene/IPA having a weight ratio of 1:1): 500 wt. parts Experiment Example B-5

The same steps as those for preparing the image-receiving sheet of the Experiment Example B-1 were carried out except that the coating material for forming the back surface layer was changed to a coating material having the following composition and an applied amount thereof was changed to 3.5 g/m$^2$, thereby preparing an image-receiving sheet for thermal transfer printing (hereinafter referred to as the "Experiment Example B-5").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 3.5 g/m$^2$ (applied amount)

Composition of the coating material for forming the back surface layer:

1̂ Polyvinyl butyral (#5000A manufactured by Denki Kagaku Kogyo K.K.): 30 wt. parts 2̂ Microsilica (SYLYSIA 730 manufactured by Fuji Shirishia Kagaku K.K.): 60 wt. parts 3̂ Microsilica (SYLYSIA 310 manufactured by Fuji Shirishia Kagaku K.K.): 30 wt. parts 4̂ Chelating Agent (ORGANATIX TC-750 manufactured by Matsumoto Seiyaku K.K.): 5 wt. parts 5̂ Nylon filler (MW-330 manufactured by Shinto Toryo K.K.): 5 wt. parts 6̂ Solvent (toluene/IPA having a weight ratio of 1:1): 500 wt. parts Experiment Example b-1

The same steps as those for preparing the image-receiving sheet of the Experiment Example B-1 were carried out except that the coating material for forming the back surface layer was changed to a coating material having the following composition, thereby preparing an image-receiving sheet for thermal transfer printing (hereinafter referred to as the "Comparison Example b-1").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 2.0 g/m$^2$ (applied amount)

Composition of the coating material for forming the back surface layer:

1̂ Polyurethane (HMS-20 manufactured by Nihon Polyurethane Kogyo K.K.): 50 wt. parts 2̂ Calcium carbonate (HAKUENKA PZ manufactured by Shiraishi Kogyo K.K.): 50 wt. parts 3̂ Solvent (toluene/IPA having a weight ratio of 1:1): 400 wt. parts Tests and results For each of samples of a series B of examples prepared as mentioned above, the following tests were carried out in the same manner as in the series A of examples:

1) Writing property of the back surface of the image-receiving sheet;

2) Stamp adhesion property of the back surface of the image-receiving sheet; and 3) Dye stain resistance of the back surface of the image-receiving sheet.

Results of these tests are shown in Table 5.

TABLE 5

| | writing property | | | | | |
|---|---|---|---|---|---|---|
| | Pencil | Aqueous-ink type pen | Oil-ink type pen | Ball point pen | Stamp adhesion property | Dye stain resistance |
| Experiment Example B-1 | ○ | ○ | ○ | ○ | ○ | Δ |
| Experiment Example B-2 | ○ | ○ | ○ | ○ | ○ | Δ |
| Experiment Example B-3 | ○ | ○ | ○ | ○ | ○ | ○ |
| Experiment Example B-4 | ○ | ○ | ○ | ○ | ○ | ○ |
| Experiment Example B-5 | ○ | ○ | ○ | ○ | ○ | ○ |
| Comparison Example b-1 | Δ | X | ○ | Δ | X | X |

As is clear from the evaluation results shown in Table 5, the Comparison Example b-1 was poor in any one of the writing property, the stamp adhesion property and the dye stain resistance, thus revealing unfavorable problems.

On the contrary, any one of the Experiment Examples B-1 to B-5 were excellent in the writing property with the use of any kind of the writing means as well as in the stamp adhesion property. With respect to the dye stain resistance, almost no transfer of the dye was found or there was found a slight transfer of the dye, however causing no practical problems, thus revealing good results.

Experiment Example C

Experiment Example C-2

A synthetic paper having a thickness of 150 $\mu$m ("YUPO FPG#150" manufactured by Ohji Yukagoseishi K.K.) was used as a substrate. A coating material for forming a back surface layer having the following composition was applied onto one surface of the substrate in an applied amount of 2.0 g/m$^2$ (in solid content) by means of the roll coating method, and the thus applied coating material was dried to form the back surface layer. Then, a coating material for forming a release layer having the following composition was applied onto the thus formed back surface layer in an applied amount of 0.1 g/m$^2$ (in solid content) by means of the roll coating method, and the thus applied coating material was dried to form the release layer. Then, a coating material for forming a front surface-side intermediate layer was applied onto the other surface of the substrate in an applied amount of 2.0 g/m$^2$ (in solid content) in the same manner as mentioned above, and the thus applied coating material was dried to form the front surface-side intermediate layer. Then, a coating material for forming a color receptor layer was applied onto the thus formed front surface-side intermediate layer in an applied amount of 5.0 g/m$^2$ (in solid content) in the same manner as mentioned above, and the thus applied coating material was dried to form the color receptor layer, thereby preparing an image-receiving sheet for thermal transfer printing (hereinafter referred to as the "Experiment Example C-1").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 2.0 g/m$^2$ (applied amount)

Release layer: 0.1 g/m$^2$ (applied amount)

Composition of the coating material for forming the back surface layer:

1̂ Polyurethane (HMS-20 manufactured by Nihon Polyurethane Kogyo K.K.): 50 wt. parts 2̂ Microsilica (SYLYSIA 550 manufactured by Fuji Shirishia Kagaku K.K.): 50 wt. parts 3̂ Solvent (toluene/IPA having a weight ratio of 1:1): 400 wt. parts Composition of the coating material for forming the release layer:

1̂ PVA (GOHSENOL GH-20 manufactured by Nihon Goseikagaku Kogyo K.K.): 3 wt. parts 2̂ Ion-exchanged water: 97 wt. parts Composition of the coating material for forming the front surface-side intermediate layer:

1̂ Polyurethane (N-5199 manufactured by Nihon Polyurethane Kogyo K.K): 50 wt. parts 2̂ Titanium oxide (TCA-888 manufactured by Tochem Product): 50 wt. parts 3̂ Solvent (toluene/MEK having a weight ratio of 1:1): 400 wt. parts Composition of the coating material for forming the color receptor layer:

1̂ Vinyl chloride-vinyl acetate copolymer (#1000A manufactured by Denki Kagaku Kogyo K.K.): 75 wt. parts 2̂ Polyester (BAYLON 600 manufactured by Toyobo K.K.): 25 wt. parts 3̂ Catalyst-hardening type silicone (X62-1212 manufactured by Shinetsu Kagaku Kogyo K.K.): 6 wt. parts 4̂ Platinum catalyst (PL-50T manufactured by Shinetsu Kagaku Kogyo K.K.): 3 wt. parts 5̂ Solvent (toluene/MEK having a weight ratio of 1:1): 400 wt. parts Experiment Example C-2

There was obtained the same structure as that is the image-receiving sheet of the Experiment Example C-1, which comprised the substrate, the front surface-side intermediate layer and the color receptor layer, a back surface-side intermediate layer was newly formed between the substrate and the back surface layer, and the material for forming the back surface layer and the material for forming the release layer were changed.

More specifically, a coating material for forming a back surface-side intermediate layer having the following composition was applied onto one surface of the substrate which comprised a synthetic paper having a thickness of 150 $\mu$m in an applied amount of 1.0 g/m$^2$ (in solid content) by means of the roll coating method, and the thus applied coating material was dried to form the back surface-side intermediate layer. Then, a coating material for forming the back surface layer having the following composition was applied onto the thus prepared back surface-side intermediate layer in an applied amount of 2.0 g/m$^2$ (in solid content) in the same manner, and the thus applied coating material was dried to form the back surface layer. Then, a coating material for forming the release layer having the following composition was applied onto the thus prepared back surface layer in an applied amount of 0.1 g/m$^2$ (in solid content) in the same manner, and the thus applied coating material was dried to form the release layer.

Then, the same front surface-side intermediate layer and color receptor layer as those in the image-receiving sheet of the Experiment Example C-1 were formed in this order and in the same manner on the other surface of the substrate, thereby preparing an image-receiving sheet for thermal transfer printing (hereinafter referred to as the "Experiment Example C-2").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface-side intermediate layer: 1.0 g/m$^2$ (applied amount)

Back surface layer: 2.0 g/m$^2$ (applied amount)

Release layer: 0.1 g/m$^2$ (applied amount)

Composition of the coating material for forming the back surface-side intermediate layer:

1̂ Polyurethane (N-5199 manufactured by Nihon Polyurethane Kogyo K.K.): 50 wt. parts 2̂ Titanium oxide (TCA-888 manufactured by Tochem Product): 50 wt. parts 3̂ Solvent (toluene/MEK having a weight ratio of 1:1): 400 wt. parts Composition of the coating material for forming the back surface layer:

1̂ Polyvinyl butyral (#5000-A manufactured by Denki Kagaku Kogyo K.K.): 50 wt. parts 2̂ Microsilica (SYLYSIA 550 manufactured by Fuji Shirishia Kagaku K.K.): 50 wt. parts 3̂ Solvent (toluene/IPA having a weight ratio of 1:1): 400 wt. parts Composition of the coating material for forming the release layer:

1̂ PVA (GOHSENOL KH-20 manufactured by Nihon Goseikagaku Kogyo K.K.): 3 wt. parts 2̂ Ion-exchanged water: 97 wt. parts Experiment Example C-3

The same steps as those for preparing the image-receiving sheet of the Experiment Example C-1 were carried out except that the coating materials for forming the back surface layer and the release layer were changed to coating materials having the following compositions, respectively, and an applied amount of the coating material for forming the back surface layer was changed to 3.0 g/m$^2$ (in solid content) and an applied amount of the coating material for forming the release layer was changed to 0.2 g/m$^2$ (in solid content), thereby preparing an image-receiving sheet for thermal transfer printing (hereinafter referred to as the "Experiment Example C-3").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 3.0 g/m$^2$ (applied amount)

Release layer: 0.2 g/m$^2$ (applied amount)

Composition of the coating material for forming the back surface layer:

1̂ Polyvinyl butyral (#3000-1 manufactured by Denki Kagaku Kogyo K.K.): 40 wt. parts 2̂ Isocyanate compound (TAKENATE D-160N manufactured by Takeda Yakuhin Kogyo K.K.): 10 wt. parts 3̂ Microsilica (SYLYSIA 730 manufactured by Fuji Shirishia Kagaku K.K.): 50 wt. parts 4̂ Solvent (toluene/IPA having a weight ratio of 1:1): 400 wt. parts Composition of the coating material for forming the release layer:

1̂ PVA (GOHSENOL KH-17 manufactured by Nihon Goseikagaku Kogyo K.K.): 3 wt. parts 2̂ Ion-exchanged water: 97 wt. parts Experiment Example C-4

The same steps as those for preparing the image-receiving sheet of the Experiment Example C-2 were carried out except that the coating materials for forming the back surface layer and the release layer were changed to coating materials having the following compositions, respectively, and an applied amount of the coating material for forming the back surface layer was changed to 2.5 g/m$^2$ (in solid content) and an applied amount of the coating material for forming the release layer was changed to 0.2 g/m$^2$ (in solid content), thereby preparing an image-receiving sheet for thermal transfer printing (hereinafter referred to as the "Experiment Example C-4").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface-side intermediate layer: 1.0 g/m$^2$ (applied amount)

Back surface layer: 2.5 g/m$^2$ (applied amount)

Release layer: 0.2 g/m$^2$ (applied amount)

Composition of the coating material for forming the back surface layer:

1̂ Polyvinyl butyral (#3000-1 manufactured by Denki Kagaku Kogyo K.K.): 30 wt. parts 2̂ Microsilica (SYLYSIA 730 manufactured by Fuji Shirishia Kagaku K.K.): 60 wt. parts 3̂ Nylon filler (MW-330 manufactured by Shinto Toryo K.K.): 5 wt. parts 4̂ Solvent (toluene/IPA having a weight ratio of 1:1): 400 wt. parts Composition of the coating material for forming the release layer:

1̂ PVA (GOHSENOL GH-14 manufactured by Nihon Goseikagaku Kogyo K.K.): 3 wt. parts 2̂ Ion-exchanged water: 97 wt. parts Experiment Example C-5

The same steps as those for preparing the image-receiving sheet of the Experiment Example C-1 were carried out except that the coating material for forming the back surface layer and an applied amount of the coating material for forming the back surface layer was changed to 3.5 g/m$^2$ (in solid content), thereby preparing an image-receiving sheet for thermal transfer printing (hereinafter referred to as the "Experiment Example C-5").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 3.5 g/m$^2$ (applied amount)

Release layer: 0.1 g/m$^2$ (applied amount)

Composition of the coating material for forming the back surface layer:

1̂ Polyvinyl butyral (#5000A manufactured by Denki Kagaku Kogyo K.K.): 30 wt. parts 2̂ Microsilica (SYLYSIA 730 manufactured by Fuji Shirishia Kagaku K.K.): 60 wt. parts 3̂ Microsilica (SYLYSIA 310 manufactured by Fuji Shirishia Kagaku K.K.): 30 wt. parts 4̂ Chelating agent (ORGATIX TC-750 manufactured by Matsumoto Seiyaku K.K.): 5 wt. parts 5̂ Nylon filler (MW-330 manufactured by Shinto Toryo K.K.): 5 wt. parts 6̂ Solvent (toluene/IPA having a weight ratio of 1:1): 520 wt. parts Comparison Example c-1

The same steps as those for preparing the image-receiving sheet of the Experiment Example C-1 were carried out except that the coating material for forming the back surface layer was changed to a coating material having the following composition (whereas an applied amount thereof was identical to that as in the Experiment Example C-1), and the release layer was deleted, thereby preparing an image-receiving sheet for thermal transfer printing (hereinafter referred to as the "Comparison Example c-1").

Structure of the image-receiving sheet for thermal transfer printing:

Color receptor layer: 5.0 g/m$^2$ (applied amount)

Front surface-side intermediate layer: 2.0 g/m$^2$ (applied amount)

Substrate: a synthetic paper having a thickness of 150 $\mu$m

Back surface layer: 2.0 g/m$^2$ (applied amount)

Composition of the coating material for forming the back surface layer:

1̂ Polyurethane (HMS-20 manufactured by Nihon Polyurethane Kogyo K.K.): 50 wt. parts 2̂ Calcium carbonate (HAKUENKA PZ manufactured by Shiraishi Kogyo K.K.): 50 wt. parts 3̂ Solvent (toluene/IPA having a weight ratio of 1:1): 400 wt. parts Tests and results For each of samples of a series C of examples prepared as mentioned above, the following tests were carried out in the same manner as in the series A of examples:

1) Writing property of the back surface of the image-receiving sheet;

2) Stamp adhesion property of the back surface of the image-receiving sheet; and 3) Dye stain resistance of the back surface of the image-receiving sheet.

The following releasing property test was also carried out. Results of these tests are shown in Table 6.

4) Releasability of the back surface of the image-receiving sheet

With the use of the same thermal transfer sheet and printer as those used in the dye stain resistance test, thermal transfer printing was conducted to print a gray gradational pattern on the back surface of each of the samples of the image-receiving sheet to investigate the occurrence of the discharging trouble of the image-receiving sheet from the printer due to the heat-fusion of the thermal transfer sheet and the image-receiving sheet so as to evaluate the releasability of the image-receiving sheet on the basis of the following criteria:

○: There was caused no heat-fusion of the thermal transfer sheet and the image-receiving sheet so that the image-receiving sheet was smoothly discharged from the printer.

X: There was caused the heat-fusion of the thermal transfer sheet and the image-receiving sheet so that the image-receiving sheet was not smoothly discharged from the printer.

TABLE 6

| | writing property | | | | | | |
|---|---|---|---|---|---|---|---|
| | Pencil | Aqueous-ink type pen | Oil-ink type pen | Ball point pen | Stamp adhesion property | Dye stain resistance | Releasability |
| Experiment Example C-1 | ○ | ○ | ○ | ○ | ○ | Δ | ○ |
| Experiment Example C-2 | ○ | ○ | ○ | ○ | ○ | ○ | ○ |
| Experiment Example C-3 | ○ | ○ | ○ | ○ | ○ | ○ | ○ |
| Experiment Example C-4 | ○ | ○ | ○ | ○ | ○ | ○ | ○ |
| Experiment Example C-5 | ○ | ○ | ○ | ○ | ○ | ○ | ○ |
| Comparison Example c-1 | Δ | X | ○ | Δ | X | X | X |

As is clear from the evaluation results shown in Table 6, the Comparison Example c-1 was poor in any one of the writing property,the stamp adhesion property, the dye stain resistance and the releasability, thus revealing unfavorable problems.

On the contrary, any one of the Experiment Examples C-1 to C-5 were excellent in the writing property with the use of any kind of the writing means as well as in the stamp adhesion property. There was caused no heat-fusion of the thermal transfer sheet and the image-receiving sheet so that the image-receiving sheet was smoothly discharged from the printer, even when the thermal transfer printing was erroneously conducted on the back surface of the image-receiving sheet, thus revealing good releasability. With respect to the dye stain resistance, almost no transfer of the dye was found or there was found a slight transfer of the dye, however causing no practical problems, thus revealing good results.

According to the present invention as described above in detail, the image-receiving sheet for thermal transfer sheet has a proper feeding property even when automatically feeding papers in a thermal transfer printer, has no problem of the transfer of the dye or the like to the back surface of the image-receiving sheet, when the image-receiving sheets after the thermal transfer printing had been stacked and stored. In addition, the back surface of the image-receiving sheet has an excellent writing property with the use of any kind of writing means and a excellent stamp adhesion property. A printed material obtained with the use of the above-mentioned image-receiving sheet can properly be used as a picture postcard.

Furthermore, When a release layer of PVA is formed on the back surface of the image-receiving sheet, the image-receiving sheet and the thermal transfer sheet can smoothly be discharged from the printer without causing the heat-fusion of them, in case that the image-receiving sheet has inadvertently been supplied upside down into the printer.

What is claimed is:

1. An image-receiving sheet for thermal transfer printing, which comprises:

a substrate;

a color receptor layer formed on one surface of said substrate; and a back surface layer formed on an other surface of said substrate, said back surface layer comprising thermoplastic resin and hydrophilic porous microsilica which is obtained by a wet process and has a pore volume of from 0.2 to 3.0 ml/g.

2. An image-receiving sheet for thermal transfer printing, as claimed in claim 1, wherein:

said thermoplastic resin of said back surface layer comprises polyvinyl butyral.

3. An image-receiving sheet for thermal transfer printing as claimed in claim 2, wherein:

said back surface layer further comprises at least one member selected from the group consisting of isocyanate compounds and chelating agents.

4. An image-receiving sheet for thermal transfer printing, as claimed in claim 1, wherein:

said microsilica of said back surface layer has an average particle size of from 0.5 to 15 $\mu$m.

5. An image-receiving sheet for thermal transfer printing, as claimed in claim 1, wherein:

said back surface layer further comprises a particulate lubricative filler having a larger particle size than that of said microsilica.

6. An image-receiving sheet for thermal transfer printing, as claimed in claim 5, wherein:

said lubricative filler is made of nylon and has an average particle size of from 1.0 to 30 $\mu$m.

7. An image-receiving sheet for thermal transfer printing, as claimed in claim 1, wherein:

said back surface layer has a weight ratio of microsilica/thermoplastic resin of from 0.1 to 3.0.

8. An image-receiving sheet for thermal transfer printing, as claimed in claim 1, wherein:

said hydrophilic porous microsilica comprises at least one hydrophilic porous microsilica having a pore volume within a range of from 0.2 to 0.9 ml/g, and at least one hydrophilic porous microsilica having a pore volume within a range of from 1.2 to 3.0 ml/g.

9. An image-receiving sheet for thermal transfer printing, as claimed in claim 1, wherein:

said back surface layer and a release layer are formed in this order on a back surface of said substrate, and said release layer comprises polyvinyl alcohol having a polymerization degree of from 500 to 3,000 and a saponification degree of from 50 to 95%.

10. An image-receiving sheet for thermal transfer printing, as claimed in claim 9, wherein:

said release layer has a thickness of from 0.01 to 1.0 μm.

11. A printed material which comprises:

a substrate;

a color receptor layer formed on one surface of said substrate, in which layer there is recorded printing information by means of a thermal transfer printing; and a back surface layer formed on an other surface of said substrate, said back surface layer comprising thermoplastic resin and hydrophilic porous microsilica which is obtained by a wet process and has a pore volume of from 0.2 to 3.0 ml/g.

12. A printed material as claimed in claim 11, wherein:

said thermoplastic resin of said back surface layer comprises polyvinyl butyral.

13. A printed material as claimed in claim 12, wherein:

said back surface layer further comprises at least one selected from the group consisting of isocyanate compounds and chelating agents.

14. A printed material as claimed in claim 11, wherein:

said microsilica of said back surface layer has an average particle size of from 0.5 to 15 μm.

15. A printed material as claimed in claim 11, wherein:

said back surface layer further comprises a particulate lubricative filler having a larger particle size than that of said microsilica.

16. A printed material as claimed in claim 15, wherein:

said lubricative filler is made of nylon and has an average particle size of from 1.0 to 30 μm.

17. A printed material as claimed in claim 11, wherein:

said back surface layer has a weight ratio of microsilica/thermoplastic resin of from 0.1 to 3.0.

18. A printed material as claimed in claim 11, wherein:

said hydrophilic porous microsilica comprises at least one hydrophilic porous microsilica having a pore volume within a range of from 0.2 to 0.9 ml/g, and at least one hydrophilic porous microsilica having a pore volume within a range of from 1.2 to 3.0 ml/g.

19. A printed material as claimed in claim 11, wherein:

said back surface layer and a release layer are formed in this order on a back surface of said substrate, and said release layer comprises polyvinyl alcohol having a polymerization degree of from 500 to 3,000 and a saponification degree of from 50 to 95%.

20. A printed material as claimed in claim 19, wherein:

said release layer has a thickness of from 0.01 to 1.0 μm.

21. A printed material as claimed in claim 11, wherein:

said printed material is used as a picture postcard.

* * * * *